US009302848B1

(12) United States Patent
Wadleigh

(10) Patent No.: US 9,302,848 B1
(45) Date of Patent: Apr. 5, 2016

(54) YARD DEBRIS COLLECTION BAG HOLDING DEVICE

(71) Applicant: Alexander Wadleigh, Round Rock, TX (US)

(72) Inventor: Alexander Wadleigh, Round Rock, TX (US)

( * ) Notice: Subject to any disclaimer, the term of this patent is extended or adjusted under 35 U.S.C. 154(b) by 0 days.

(21) Appl. No.: 14/586,411

(22) Filed: Dec. 30, 2014

(51) Int. Cl.
*B65F 1/14* (2006.01)
*B65B 67/12* (2006.01)

(52) U.S. Cl.
CPC ..... *B65F 1/1415* (2013.01); *B65B 67/12* (2013.01); *B65B 67/1238* (2013.01); *B65F 1/1468* (2013.01); *B65F 2240/138* (2013.01)

(58) Field of Classification Search
CPC . B65F 1/1415; B65F 2240/138; B65B 67/12; B65B 67/1238; B65B 67/1233
USPC ..... 248/95, 97, 99, 101
See application file for complete search history.

(56) References Cited

U.S. PATENT DOCUMENTS 1,665,724 A * 4/1928 Way ..... B65B 67/12 248/101
D236,938 S 9/1975 Bowen, Jr.
4,268,081 A * 5/1981 Hawkinson ..... B65B 67/1238 141/316
4,723,803 A * 2/1988 Sapp ..... B65B 67/1238 294/214
4,832,292 A * 5/1989 Beckham ..... B65B 67/1238 141/316
5,107,666 A * 4/1992 Rahtican ..... B65B 67/1238 141/316
5,261,553 A * 11/1993 Mueller ..... B65F 1/06 220/495.1
D345,642 S * 3/1994 Tucker ..... D34/10
5,400,989 A * 3/1995 Gaskill ..... B65B 67/12 248/100
5,498,046 A * 3/1996 Ridley, Sr. ..... A01D 51/00 15/257.1
6,450,461 B1 * 9/2002 Lohmann ..... B65B 67/1238 248/97
7,237,753 B2 7/2007 Metcalfe
D581,228 S * 11/2008 Meehan ..... D8/10
D639,519 S * 6/2011 Gomez ..... D34/6
2002/0100845 A1 * 8/2002 Green ..... B65B 67/12 248/101
2006/0078411 A1 * 4/2006 Casab ..... B65F 1/1415 414/408
2006/0243867 A1 * 11/2006 Strickland ..... B65B 67/1238 248/101
2009/0289154 A1 * 11/2009 Gabriel ..... A01G 1/125 248/99
2012/0043433 A1 2/2012 Hall
2012/0174535 A1 * 7/2012 Copland ..... B65B 67/1205 53/473
2013/0259405 A1 * 10/2013 Jack ..... B65B 67/04 383/33
2013/0313378 A1 * 11/2013 Gonzales, II ..... B65B 67/1238 248/101

FOREIGN PATENT DOCUMENTS

WO WO9529582 11/1995

* cited by examiner

*Primary Examiner* — Ryan Kwiecinski

(57) ABSTRACT

A yard debris collection bag holding device holds a yard debris collection bag in an open position to facilitate collection of yard debris such as leaves. The device includes a perimeter wall defining a channel extending between a first edge of the perimeter wall and a second edge of the perimeter wall. Each of a plurality of top clips is coupled to an exterior surface of the perimeter wall and each of a plurality of interior clips has a respective main section coupled to an interior surface of the perimeter wall within the channel. Each of the interior clips has a projection extending through the bottom section of the perimeter wall to clip a yard debris bag to the perimeter wall providing access to the yard debris collection bag in an open position.

11 Claims, 5 Drawing Sheets

YARD DEBRIS COLLECTION BAG HOLDING DEVICE

BACKGROUND OF THE DISCLOSURE

Field of the Disclosure

The disclosure relates to holding devices and more particularly pertains to a new holding device for holding a yard debris or yard debris bag in an open position to facilitate collection of yard debris and leaves.

SUMMARY OF THE DISCLOSURE

An embodiment of the disclosure meets the needs presented above by generally comprising a perimeter wall defining a channel extending between a first edge of the perimeter wall and a second edge of the perimeter wall. Each of a plurality of top clips is coupled to an exterior surface of the perimeter wall and each of a plurality of interior clips has a respective main section coupled to an interior surface of the perimeter wall within the channel. Each of the interior clips has a projection extending through the bottom section of the perimeter wall to clip a yard debris bag to the perimeter wall providing access to the yard debris collection bag in an open position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
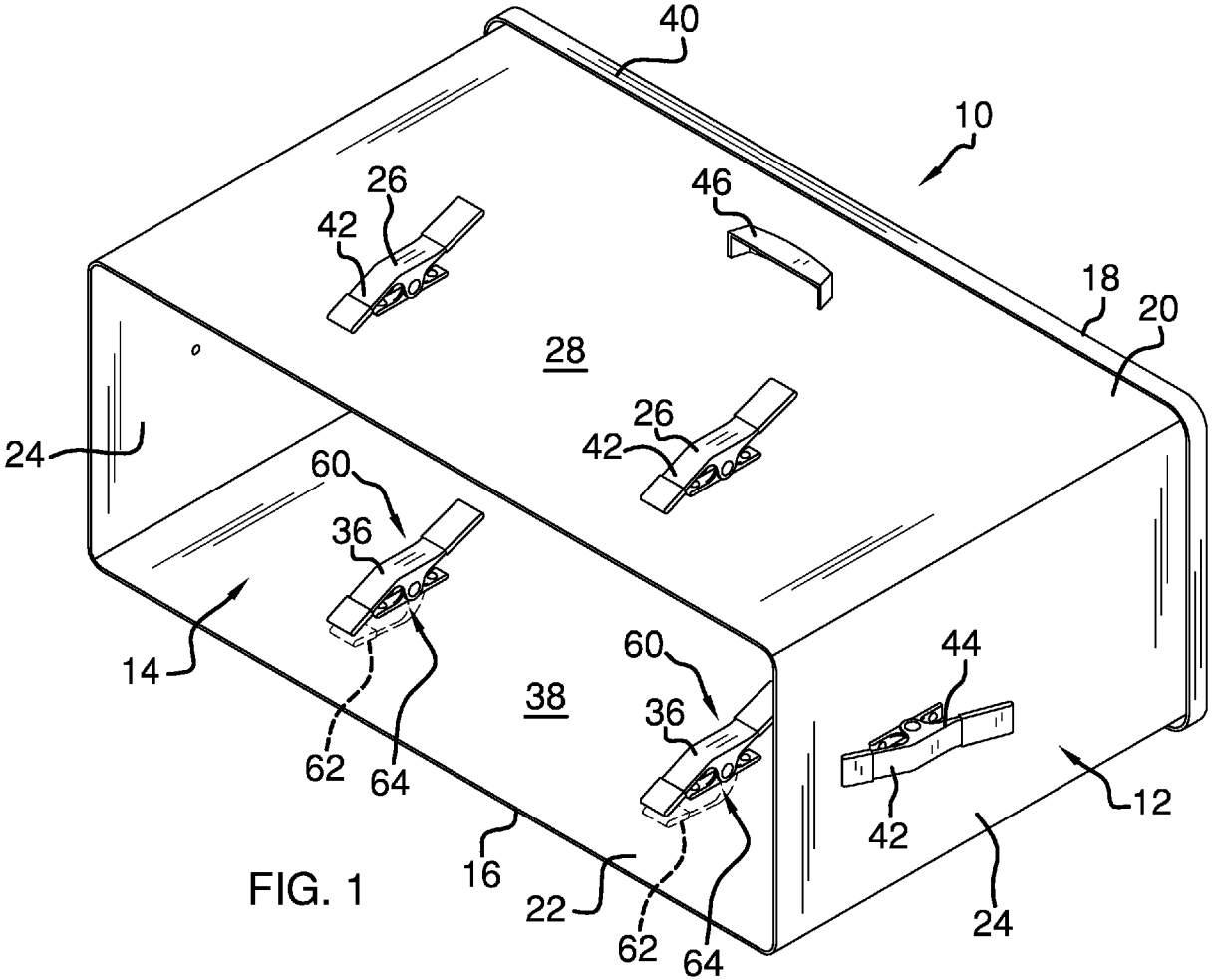
FIG. 1 is a top front side perspective view of a yard debris collection bag holding device according to an embodiment of the disclosure.
Figure 2:
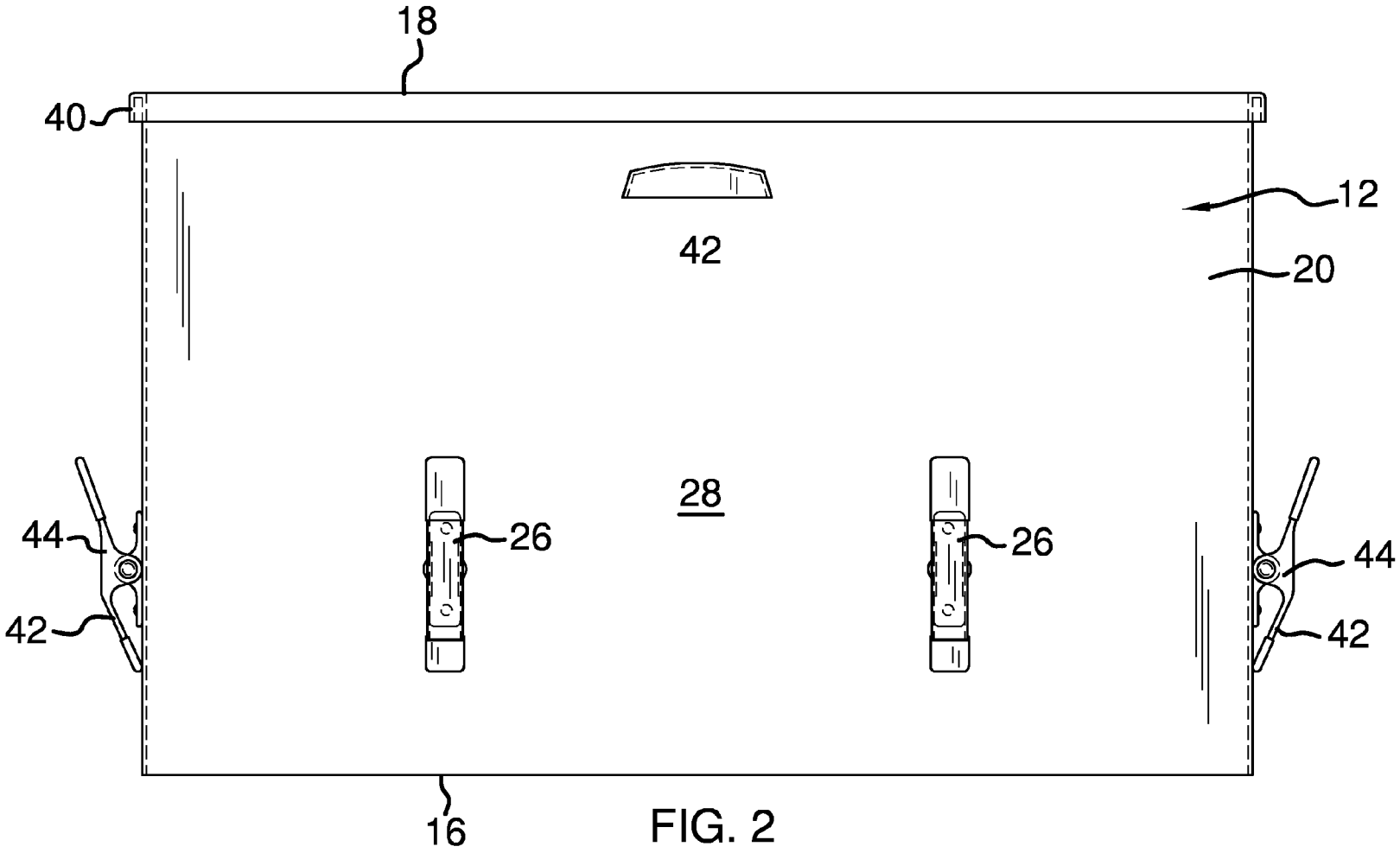
FIG. 2 is a top view of an embodiment of the disclosure.
Figure 3:
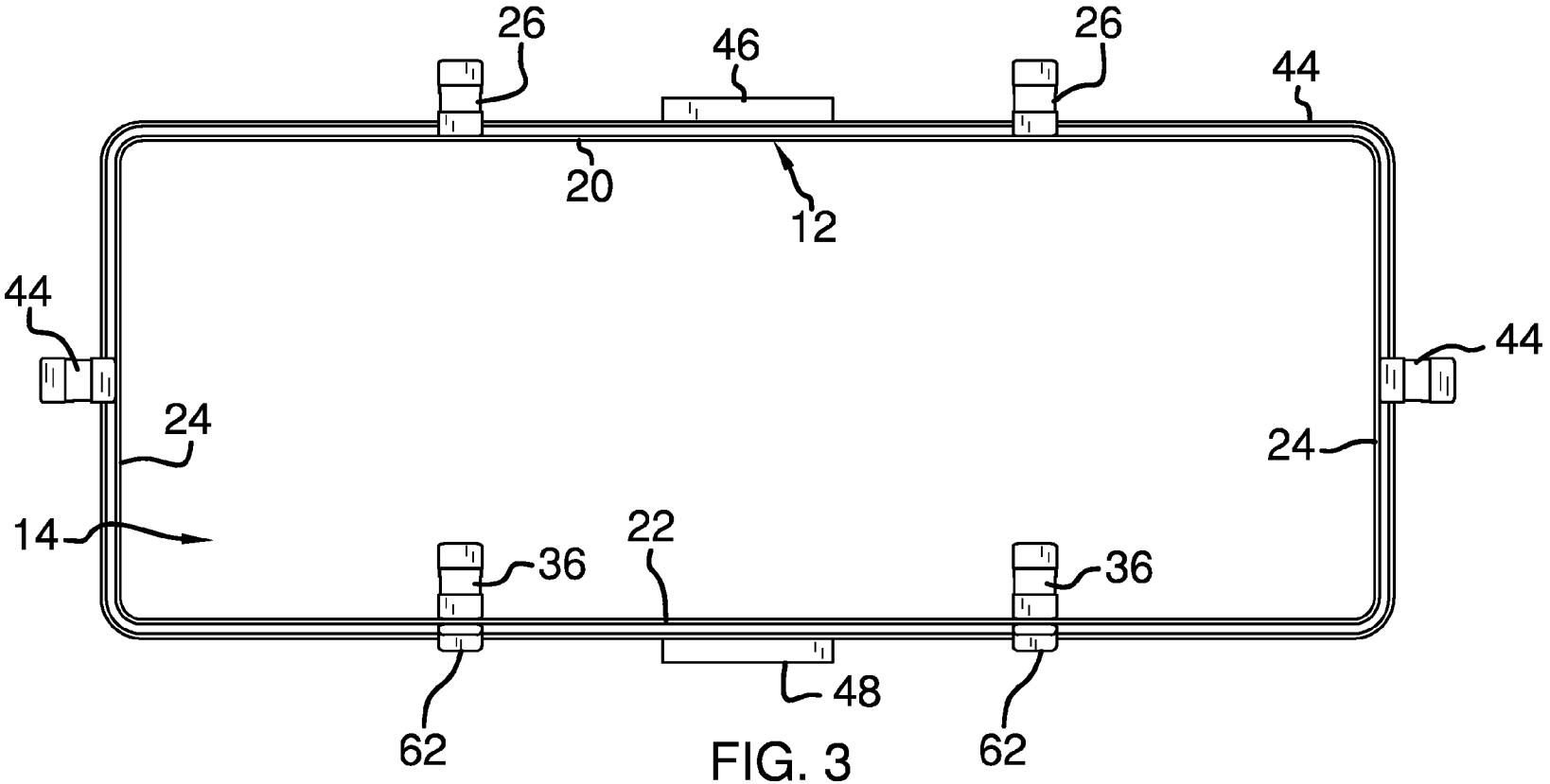
FIG. 3 is a back view of an embodiment of the disclosure.
Figure 4:
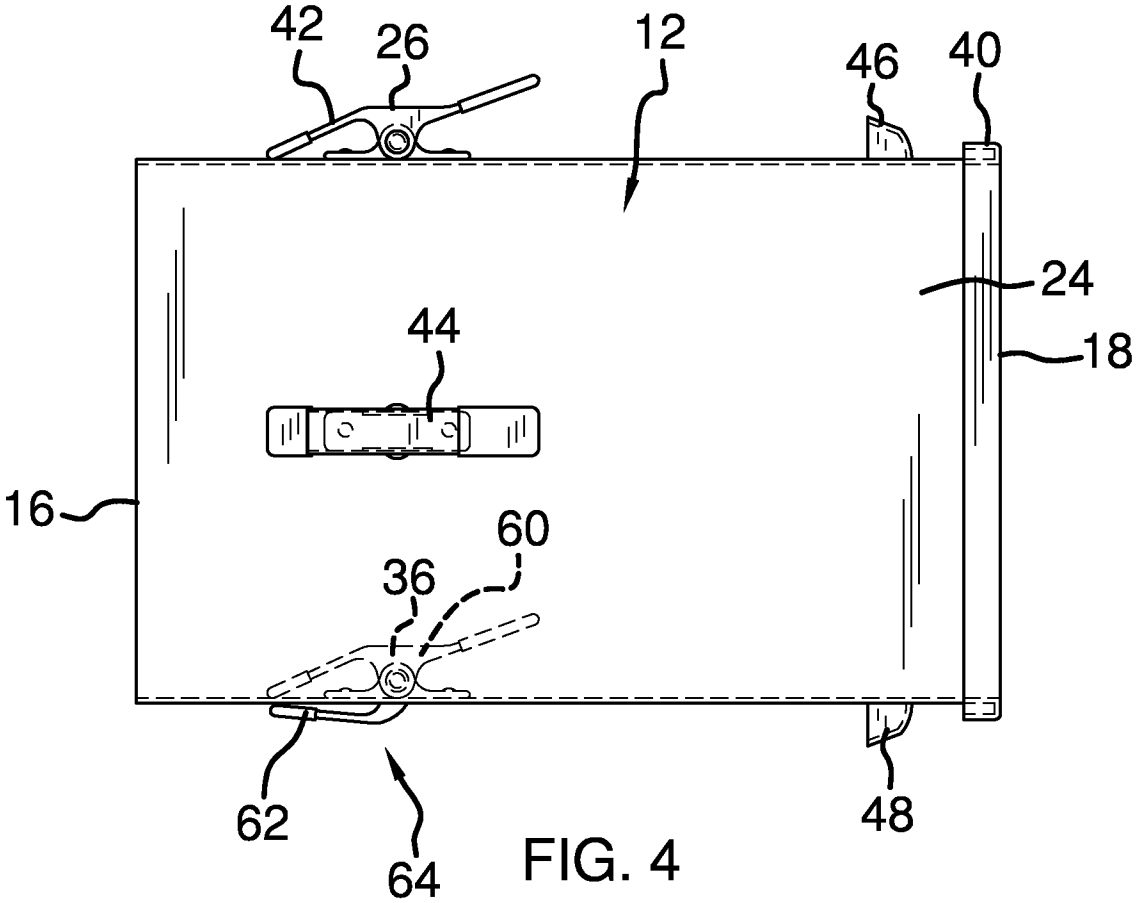
FIG. 4 is a side view of an embodiment of the disclosure.
Figure 5:
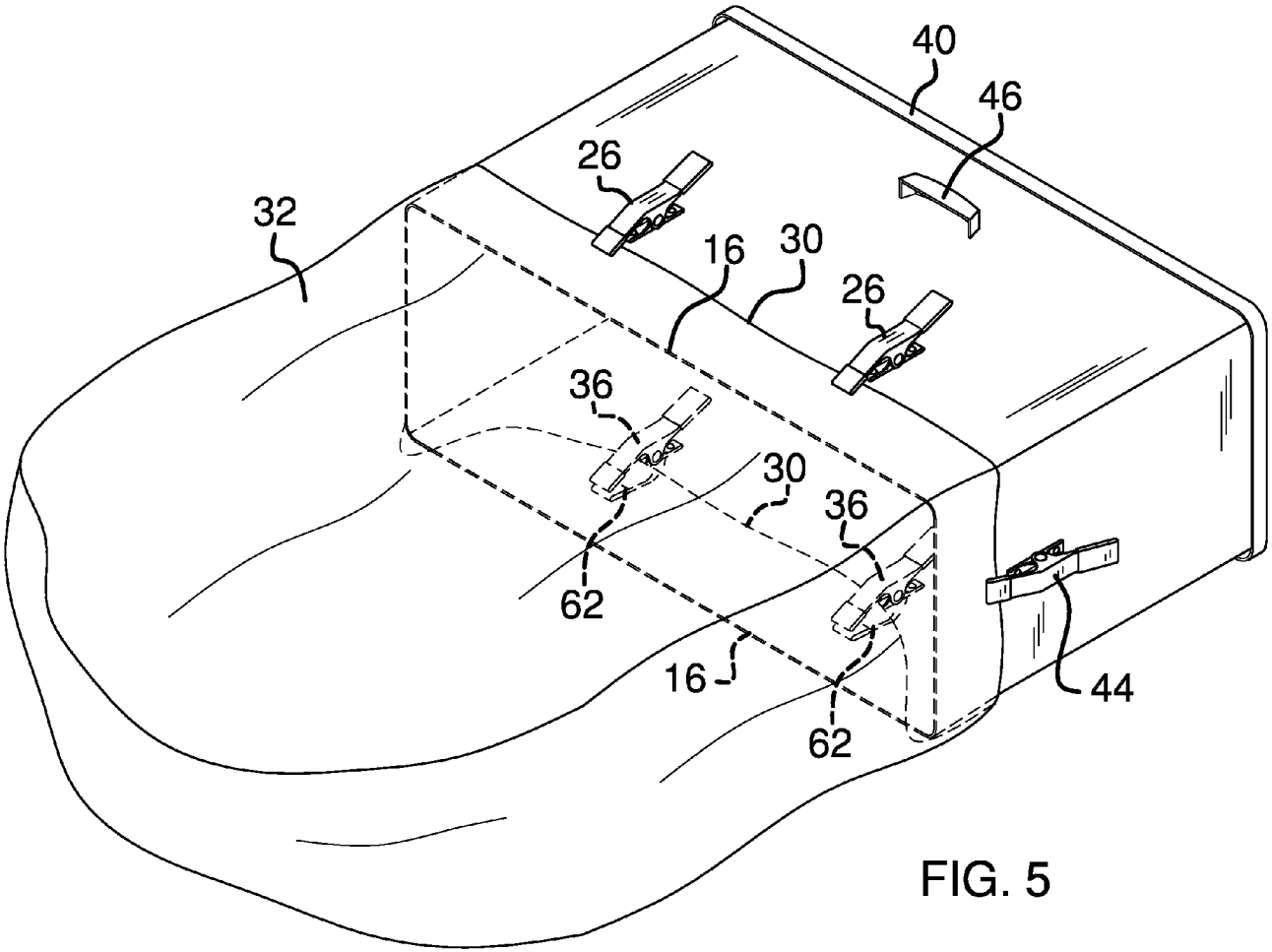
FIG. 5 is a top front side perspective view of an embodiment of the disclosure in use.

With reference now to the drawings, and in particular to FIGS. 1 through 5 thereof, a new holding device embodying the principles and concepts of an embodiment of the disclosure and generally designated by the reference numeral 10 will be described.

As best illustrated in FIGS. 1 through 5, the yard debris collection bag holding device 10 generally comprises a perimeter wall 12 defining a channel 14 extending between a first edge 16 of the perimeter wall 12 and a second edge 18 of the perimeter wall 12. The perimeter wall 12 has a top section

20, a bottom section 22, and a pair of opposed end sections 24. Each of a plurality of top clips 26 is coupled to an exterior surface 28 of the perimeter wall 12. Each of the top clips 26 is positioned on the top section 20 of the perimeter wall 12 offset from the first edge 16 of the perimeter wall 12. Thus, the top clips 26 are configured for holding an edge 30 of a yard debris collection bag 32 against the exterior surface 28 of the top section 20 of the perimeter wall 12 such that the yard debris collection bag 32 is held in an open position.

Each of a plurality of interior clips 36 has a main section 60 which is coupled to an interior surface 38 of the perimeter wall 12 within the channel 14. Each of the interior clips 36 has a respective projection 62 extending through an aperture 64 positioned on the bottom section 22 of the perimeter wall 12 wherein the exterior surface 28 of the perimeter wall 12 along the bottom section 22 of the perimeter wall 12 is configured for being positioned on a flat supporting surface to provide access to the yard debris collection bag 32 coupled to the perimeter wall 12 in the open position by the top clips 26 and the interior clips 36. The interior clips 36 are positioned inset from the first edge 16 of the perimeter wall 12 wherein the interior clips 36 are configured for holding the edge 30 of the yard debris collection bag 32 against the exterior surface 38 of the perimeter wall 12 within the channel 14. A lip 40 is coupled to and extends around the second edge 18 of the perimeter wall 12. Each of the top clips 26 may be a spring clip having an arm 42 biased against the perimeter wall 12. Each of the interior clips 36 may similarly be a spring clip wherein the projection 62 is biased against the perimeter wall 12 in a conventional manner.

Each of a pair of end clips 44 is positioned on a respective end section 24 of the perimeter wall 12. Each of the end clips 44 is positioned on the outer surface 28 of the perimeter wall 12. Each of the end clips 44 may be a spring clip having similar structure to each of the top clips 26 and the interior clips 36.

A top handle 46 is coupled to and extends from the top section 20 of the perimeter wall 12. The top handle 46 is offset from the second edge 18 of the perimeter wall 12. The top handle 46 is positioned between the top clips 26 and the second edge 18 of the perimeter wall 12. A bottom handle 48 is coupled to and extends from the bottom section 22 of the perimeter wall 12. The bottom handle 48 extends outwardly from outer surface 28 of the perimeter wall 12 away from the channel 14. The bottom handle 48 is positioned in vertical alignment with the top handle 46 wherein the top handle 46 and the bottom handle 48 are oppositely positioned across the channel 14.

In use, the yard debris collection bag 32 is secured to the perimeter wall 12 using the top clips 26, interior clips 36, and end clips 44. The perimeter wall 12 is positioned with the bottom section 22 on the ground and the second edge 18 of the perimeter wall 12 defines an open mouth into the yard debris collection bag 32. Debris may be swept into and through the device 10. The device 10 may be grasped by the top handle 46 and bottom handle 48 and held to empty debris within the channel 14 into the yard debris collection bag 32.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A yard debris collection bag holding device comprising:

a perimeter wall defining a channel extending between a first edge of said perimeter wall and a second edge of said perimeter wall, said perimeter wall having a top section, a bottom section, and a pair of opposed end sections;

a plurality of top clips, each of said plurality of top clips being coupled to an exterior surface of said perimeter wall such that an entirety of each of said plurality of top clips is positioned outside of said channel, each of said plurality of top clips being positioned on said top section of said perimeter wall; and a plurality of interior clips, each of said plurality of interior clips having a main section being coupled to an interior surface of said perimeter wall within said channel, each of said plurality of interior clips having a projection extending through said bottom section of said perimeter wall, each said projection abutting said perimeter wall in a closed position wherein each of said plurality of interior clips is configured for securing an edge of a yard debris collection bag between said projection and said exterior surface of said perimeter wall wherein said exterior surface of said perimeter wall along said bottom section of said perimeter wall is configured for being positioned on a flat supporting surface to provide access to the yard debris collection bag coupled to said perimeter wall in an open position by each of said plurality of top clips and each of said plurality of interior clips.

2. The device of claim 1, further comprising a lip coupled to and extending around said second edge of said perimeter wall.

3. The device of claim 1, further comprising said plurality of top clips being positioned offset from said first edge of said perimeter wall wherein said plurality of top clips are configured for holding an edge of said yard debris collection bag against said exterior surface of said top section of said perimeter wall wherein the yard debris collection bag is held in the open position.

4. The device of claim 3, further comprising a pair of end clips, each of said pair of end clips being positioned on a respective said end section of said perimeter wall.

5. The device of claim 4, further comprising each of said pair of end clips being positioned on said outer surface of said perimeter wall.

6. The device of claim 1, further comprising a top handle, said top handle being coupled to and extending from said top section of said perimeter wall.

7. The device of claim 6, further comprising said top handle being offset from said second edge of said perimeter wall.

8. The device of claim 6, further comprising said top handle being positioned between said plurality of top clips and said second edge of said perimeter wall.

9. The device of claim 6, further comprising a bottom handle, said bottom handle being coupled to and extending from said bottom section of said perimeter wall, said bottom handle extending outwardly from outer surface of said perimeter wall away from said channel.

10. The device of claim 9, further comprising said bottom handle being positioned in vertical alignment with said top handle wherein said top handle and said bottom handle are oppositely positioned across said channel.

11. A yard debris collection bag holding device comprising:

a perimeter wall defining a channel extending between a first edge of said perimeter wall and a second edge of said perimeter wall, said perimeter wall having a top section, a bottom section, and a pair of opposed end sections;

a plurality of top clips, each of said plurality of top clips being coupled to an exterior surface of said perimeter wall such that an entirety of each of said plurality of top clips is positioned outside of said channel, each of said plurality of top clips being positioned on said top section of said perimeter wall, each of said plurality of top clips being positioned offset from said first edge of said perimeter wall wherein each of said plurality of top clips are configured for holding an edge of said yard debris collection bag against said exterior surface of said top section of said perimeter wall wherein the yard debris collection bag is held in the open position;

a plurality of interior clips, each of said plurality of interior clips having a main section being coupled to an interior surface of said perimeter wall within said channel, each of said plurality of interior clips having a projection extending through said bottom section of said perimeter wall, each said projection abutting said perimeter wall in a closed position wherein each of said plurality of interior clips is configured for securing an edge of a yard debris collection bag between said projection and said exterior surface of said perimeter wall wherein said exterior surface of said perimeter wall along said bottom section of said perimeter wall is configured for being positioned on a flat supporting surface to provide access to the yard debris collection bag coupled to said perimeter wall in an open position by each of said plurality of top clips and each of said plurality of interior clips, each of said plurality of interior clips being positioned inset from said first edge of said perimeter wall wherein each of said plurality of interior clips is configured for holding an edge of a yard debris collection bag against said exterior surface of said perimeter wall;

a lip coupled to and extending around said second edge of said perimeter wall;

a pair of end clips, each of said pair of end clips being positioned on a respective said end section of said perimeter wall, each of said pair of end clips being positioned on said outer surface of said perimeter wall;

a top handle, said top handle being coupled to and extending from said top section of said perimeter wall, said top handle being offset from said second edge of said perimeter wall, said top handle being positioned between said top clips and said second edge of said perimeter wall; and a bottom handle, said bottom handle being coupled to and extending from said bottom section of said perimeter wall, said bottom handle extending outwardly from outer surface of said perimeter wall away from said channel, said bottom handle being positioned in vertical alignment with said top handle wherein said top handle and said bottom handle are oppositely positioned across said channel.

* * * * *